United States Patent [19]

Craig et al.

[11] 4,109,056

[45] Aug. 22, 1978

[54] STARCH/LATEX CAST COATINGS FOR PAPER

[75] Inventors: Gerald Craig, Hamilton; Wilbur G. Evans, Oxford; Everett L. Potts, Jr., Hamilton, all of Ohio

[73] Assignee: Champion International Corporation, Stamford, Conn.

[21] Appl. No.: 762,522

[22] Filed: Jan. 26, 1977

Related U.S. Application Data

[63] Continuation-in-part of Ser. No. 574,718, May 5, 1976, abandoned.

[51] Int. Cl.[2] ..... B32B 23/08; B32B 27/10; C08L 3/02

[52] U.S. Cl. ..... 428/512; 260/17.4 ST; 428/535

[58] Field of Search ..... 260/17.4 ST; 428/512

[56] References Cited

U.S. PATENT DOCUMENTS

| | | | |
|---|---|---|---|
| 3,020,176 | 2/1962 | Robinson et al. | 427/362 X |
| 3,282,866 | 11/1966 | Pohlemann et al. | 260/17.4 ST |
| 3,341,392 | 9/1967 | Potter | 428/533 X |
| 3,395,072 | 7/1968 | Talet et al. | 260/17.4 ST |
| 3,399,074 | 8/1968 | Gottwald et al. | 427/362 |
| 3,832,216 | 8/1974 | Cressey | 427/362 |
| 3,925,328 | 12/1975 | Shibahara et al. | 260/17.4 ST |
| 3,939,108 | 2/1976 | Sirota et al. | 260/17.4 ST |

*Primary Examiner*—Edward M. Woodberry
*Attorney, Agent, or Firm*—Evelyn M. Sommer

[57] ABSTRACT

A non-proteinaceous binder is provided for cast coating of paper which comprises three primary components: a modified starch; a styrene-butadiene latex characterized by a particle size of about 800 to about 1300 angstroms, a solids content of between about 45.0 and about 47.0%, a maximum 200 mesh residue of about 0.075 gms./900 mls., a pH of between about 3.8 and 4.8, a maximum Brookfield viscosity of about 100, and a surface tension of between about 43.0 and about 49.0; and a second styrene-butadiene latex characterized by a particle size of about 1350 to about 1650 angstroms, a solids content of between about 47.0 and about 49.0%, a maximum 200 mesh residue of about 0.05 gms./900 mls., a pH of between about 5.5 and 6.5, a maximum Brookfield viscosity of about 300 cps., and a surface tension of between about 49.0 and 55.0. An aqueous aliquot portion of the composition is coated on a paper substrate, pressed against a chromium heat roll and dried, thereby providing a cast coated paper according to the invention.

13 Claims, No Drawings

STARCH/LATEX CAST COATINGS FOR PAPER

CROSS-REFERENCE TO RELATED APPLICATIONS

This application is a continuation-in-part application of our copending application Ser. No. 574,718 filed May 5, 1976 for Starch/Latex Cast Coatings for Paper now abandoned.

BACKGROUND OF THE INVENTION

The present invention relates to a non-proteinaceous binder, coating system or coating composition especially adapted for the cast coating of paper, as described in U.S. Pat. Nos. 1,719,166 and 2,568,288 (Reissue No. Re. 23,637), these disclosures being incorporated herein by reference.

Casein, a proteinaceous material, has been the chief adhesive component in cast coating of paper since the origin of this process. However, casein has been the source of many price and availability fluctuations and has other disadvantages.

Attempts to replace the casein with synthetic latices have been unsuccessful, unrewarding or commercially impractical. Such prior attempts have been dependent upon employing an alkali-swellable or alkali-soluble polymer latex blended with an alkali-insoluble and non-alkali-swellable latex. More recently it has been proposed to maintain the compositions in which these latices are employed at acidic levels.

We have now found a particular non-proteinaceous binder for cast coating of paper comprising a modified starch and two styrene-butadiene latices of specific characteristics, which is highly suitable for its intended purpose. Our novel binder eliminates the need for casein and provides many advantages over heretofore known synthetically based compositions.

The cast coating of paper places rigorous demands and restraints on the type of coating binders that can be used successfully. One of the main requirements for a suitable binder in the cast coating operation is sustained drum release. In its simplest form the cast coating operation comprises applying an aqueous coating to a paper substrate. The coating is pressed against a rotating heated chromium surface. In the process the coating must stick and conform to the chromium surface while wet, but on drying must have auto-releasing properties.

The coating within the scope of this invention yields a commercial quality sheet of outstanding print quality, press performance, sheet gloss, water-resistance, fold, and freedom from curling of the paper. It also permits maximum drum speed in the coating operation.

SUMMARY OF THE INVENTION

Generally speaking, in accordance with the invention, our novel coating composition comprises an acidic aqueous admixture of acid hydrolyzed hydroxyethyl ether corn starch, a styrene-butadiene polymer latex of specific character, and a second styrene-butadiene polymer latex of specific character, the character of the second such latex being distinct from the first. While these are essential components of the composition, it is the particular combination of these components in a system including a filler, dispersants, a release agent and an adhesion promoter that provides the highly satisfactory results sought and heretofore unobtainable in the art.

The composition is applied to a paper web by coating the web therewith, pressing the coated web against a hot chromium surface and drying the hot-pressed web.

Accordingly, it is an object of the invention to provide a novel composition for cast coating of paper.

Another object of the invention is to provide an improved synthetic system for cast coating paper.

A further object of the invention is to provide a satisfactory composition for cast coating paper wherein casein is excluded and a blend of specific styrene-butadiene latices is substituted therefor.

Still other objects and advantages of the invention will in part be obvious and will in part be apparent from the specification.

The invention accordingly comprises a composition possessing the characteristics, properties, and the relation of constituents which will be exemplified in the composition hereinafter described, and the scope of the invention will be indicated in the claims.

DETAILED DESCRIPTION OF THE INVENTION

The coating composition comprises, essentially, an aqueous admixture of acid hydrolyzed hydroxyethyl ether cornstarch, and two distinct styrene-butadiene latices of specific character. These constituents are admixed in relative dry weight proportions of substantially 1:2:2, and the relative amounts of each constituent may vary within the limits hereinafter set forth. The pH of the coating composition is adjusted to between about 9.5 and about 10.0.

Among the reasons that an acid hydrolyzed hydroxyethyl ether cornstarch is suited to a cast coating composition is its reduced tendency to gel or retrograde and its hydrophilic character. Such starches are well known, and one such suitable starch is commercially available under the tradename Amaizo 745-D, a product of American Maize Products Co. Preferably, between about 3 and about 5 parts of the starch are included in the composition, calculated on a dry weight basis.

Both latices employed in the coating composition include dispersed styrene-butadiene polymer. The particle size of styrene-butadiene in one latex preferably varies from about 800 to about 1300 angstroms, and the latex is characterized by a solids content of between about 45.0 and about 47.0%, a maximum 200 mesh residue of about 0.07.5 gms./900 mls., a pH of about 3.8 to about 4.8, a maximum Brookfield viscosity of about 100, cps. and a surface tension of about43.0 to about 49.0. Styrene-butadiene latices and their preparation are well known, and one such latex having the character and properties described herein is commercially available, for instance, under the tradename Dow Latex 650, a product of Dow Chemical Company. Preferably, from about 6 to about 8 parts of this latex are employed in the coating composition, calculated on a dry weight basis.

The other latex includes dispersed styrene-butadiene polymer having a particle size varying from about 1350 to about 1650 angstroms. This latex is characterized by a solids content of about 47.0 to about 49.0%, a maximum 200 mesh residue of about 0.05 gms./900 mls., a pH of between about 5.5 and about 6.5, a maximum Brookfield viscosity of about 300 cps., and a surface tension of from about 49.0 to about 55.0. The coating composition preferably includes from about 6 to about 8 parts of this latex, calculated on the dry weight basis.

The preferred form of the coating composition includes an insoluble filler, an inorganic polyphosphate dispersant, a polyacrylate dispersant, an oleaginous release agent and rosin which promotes adhesion of the coating to a paper web, without deleterious effect. The preferred insoluble filler is a mineral filler comprising about 85 parts calcium carbonate and about 15 parts #2 coating clay. In a particularly preferred embodiment of the invention, the calcium carbonate employed is precipitated calcium carbonate having a specific surface of about 35,000 to about 40,000 sq. centimeters/gram, and the #2 coating clay is of the kaolin type having a particular size of 82% less than 2 microns.

Preferred inorganic polyphosphate dispersants employed in the coating composition are the hexametaphosphates. Among the most preferred hexametaphosphates are sodium hexametaphosphate and zinc substituted sodium hexametaphosphate which are respectively commercially available under the trademarks Calgon(a product of the Calgon Corporation) and Calgon T(a product of Merck & Company). Preferably, about 0.5 parts, calculated on the dry weight basis, of the inorganic polyphosphate dispersant are employed in the composition.

An aqueous solution of sodium polyacrylate is the preferred polyacrylate dispersant for the coating composition, and preferably about 0.7 parts, calculated on the dry weight basis, are employed therein. Typical commercially available sodium polyacrylate dispersants are Tamol 850(a product of Rohm & Haas Company), Dow XD-7321(a product of Dow Chemical Company), and Dispex N-40( a product of Allied Colloids).

Suitable oleaginous release agent which may be employed in the composition are disclosed in U.S. Pat. No. 2,568,288 issued Sept. 18, 1951, Reissue No. Re. 23,637, such as for example the agents disclosed in the Reissue at column 3, line 39 to column 4, line 54, and in the Examples of said Reissue, which disclosure is incorporated herein by reference. The preferred oleaginous release agent, however, is sulfonated castor oil. From about 1.5 to about 1.75 parts, calculated on the dry weight basis, of the oleaginous release agent are preferably employed in the coating composition.

Preferably, the coating composition includes a suitable rosin which promotes adhesion of the coating to the paper web, without deleterious effect. A preferred rosin is an acidic thermoplastic pentaerythritol rosin ester, and particularly the sodium salt thereof. For example, the preferred rosin is commercially available under the tradename Pentalyn 856(a product of Hercules Incorporated). In the most preferred embodiment of the invention about 1.0 parts of the rosin are employed in the composition.

The pH of the composition may be adjusted to the desired range by the addition of ammonia thereto. As formulated, the coating composition preferably has a solids content of 55 to about 60%.

It is surprising that, in the particular combination employed, the various disadvantages that each of the essential constituents may exhibit individually is overcome. Thus, while the starch functions as a thermosetting binder and aids casting drum release and imparts ink attack resistance, it is not easily waterproofed (a property a cast coating must have), and it interacts with the first-mentioned latex to build unmanageable coating viscosities. While that latex increases ink attack resistance and apparently aids in waterproofing starch, it has less than desired drum release properties.

The second-mentioned latex imparts release properties but its sheet surface is poor. However, when these three constituents are employed in combination within the ranges specified, the undesirable properties of each are minimized and the aforesaid desired properties are enhanced.

In the general preparation of the coating composition, the heretofore disclosed constituents may be added in any appropriate sequence to a sufficient amount of water to give the desired total solids content and pH thereof.

The examples that follow are merely exemplary of specific embodiments of the invention, and are not otherwise intended to limit the scope thereof. All parts are by dry weight on the composition.

EXAMPLE I

A coating composition is formulated including 3 parts acid hydrolyzed hydroxyethyl ether corn starch, 8 parts of the latex including dispersed styrene-butadiene polymer of particle size between 800 and 1300 angstroms, and 8 parts of the latex including dispersed styrene-butadiene polymer of particle size between 1350 and 1650 angstroms.

EXAMPLE II

A coating composition is formulated including 4 parts acid hydrolyzed hydroxyethyl ether corn starch, 8 parts of the latex including dispersed styrene-butadiene polymer of particle size between 800 and 1300 angstroms, and 6 parts of the latex including dispersed styrene-butadiene polymer of particle size between 1350 and 1650 angstroms.

EXAMPLE III

A coating composition is formulated including 5 parts acid hydrolyzed hydroxyethyl ether corn starch, 6 parts of the latex including dispersed styrene-butadiene polymer of particle size between 800 and 1300 angstroms, and 8 parts of the latex including dispersed styrene-butadiene polymer of particle size between 1350 1650 angstroms.

The preferred formulation is that of Example III. With that formulation, the drum release of the coatings is at maximum efficiency.

In employing the formulations in the cast coating of paper, the aqueous coating composition is applied to a paper web and pressed against a rotating heated chromium surface and then dried in the manner described in the above incorporated patents. By means of the above described coating compositions there are obtained cast coated papers of high printing quality, press performance, sheet gloss, water resistance, fold, and freedom from curling.

It will thus be seen that the objects set forth above, among those made apparent from the preceding description, are efficiently attained and, since certain changes may be made in the composition set forth and the method of its use without departing from the spirit and scope of the invention, it is intended that all matter contained in the above description shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A non-proteinaceous binder for cast surface coating of paper which comprises an aqueous admixture of acid hydrolyzed hydroxyethyl ether corn starch; a first styrene-butadiene polymer latex having a particle size of from about 800 to about 1300 angstroms, said first latex being characterized by a solids content of between about 45.0 and about 47.0%, a maximum 200 mesh residue of about 0.075 grms/900 mls., a pH of about 3.8 to about 4.8, a maximum Brookfield viscosity of about 100 cps. and a surface tension of about 43.0 to about 49.0; and a second styrene-butadiene polymer latex having a particle size of from about 1350 to about 1650 angstroms, said second latex being characterized by a solids content of between about 47.0 and about 49.0%, a maximum 200 mesh residue of about 0.05 gms./900 mls, a pH of between about 5.5 and about 6.5, a maximum Brookfield viscosity of about 300 cps., and a surface tension of from about 49.0 to about 55.0; said starch and said first and second latices being adjusted in relative proportions of about 1:2:2 dry weight of said composition such that said composition has a pH of between about 9.5 and about 10, and a solids content of about 55 to about 60%.

2. The binder as claimed in claim 1, wherein said composition includes from about 3 to about 5 parts of said starch, from about 6 to about 8 parts of said first latex, and from about 6 to about 8 parts of said second latex.

3. The binder as claimed in claim 2 including about 0.5 parts of an inorganic polyphosphate dispersant; about 0.7 parts of a polyacrylate dispersant; from about 1.5 to about 1.75 parts of an oleaginous release agent; and about 1.0 part of a rosin which promotes adhesion between said composition and a paper web, all parts being calculated on a dry weight basis.

4. The binder as claimed in claim 3 including an insoluble filler.

5. The binder as claimed in claim 4 said filler comprising a mineral filler including about 85 parts calcium carbonate and about 15 parts #2 coating clay.

6. The binder as claimed in claim 5, wherein said calcium carbonate is precipitated calcium carbonate having a specific surface of about 35,000 to about 40,000 sq. cms./gm., and said #2 coating clay is a kaolin clay having a particle size of 82% less than 2 microns.

7. The binder as claimed in claim 3, wherein said inorganic polyphosphate dispersant is a hexametaphosphate.

8. The binder as claimed in claim 7, wherein said hexametaphosphate is sodium hexametaphosphate or zinc substituted sodium hexametaphosphate.

9. The binder as claimed in claim 3, wherein said polyacrylate dispersant is aqueous sodium polyacrylate.

10. The binder as claimed in claim 3, wherein said oleaginous release agent is sulfonated castor oil.

11. The binder as claimed in claim 3, wherein said rosin is the sodium salt of pentaerythritol rosin ester.

12. Paper cast surface coated with said binder of claim 1.

13. In a process of making cast surface coated paper, the improvement which comprises employing the binder of claim 1.

* * * * *